US007171721B2

(12) United States Patent
Hauff et al.

(10) Patent No.: US 7,171,721 B2
(45) Date of Patent: Feb. 6, 2007

(54) CLEANING APPARATUS FOR DISPENSING A HEATED CLEANING FLUID

(75) Inventors: Douglas Hauff, Otis Orchards, WA (US); Steve Williams, Hayden Lake, ID (US); William A. Fuglevand, Spokane, WA (US); Greg A. Lloyd, Spokane, WA (US)

(73) Assignee: Palouse Holdings, LLC, Coeur d'Alene, ID (US)

( * ) Notice: Subject to any disclaimer, the term of this patent is extended or adjusted under 35 U.S.C. 154(b) by 562 days.

(21) Appl. No.: 10/663,182

(22) Filed: Sep. 15, 2003

(65) Prior Publication Data

US 2005/0055793 A1 Mar. 17, 2005

(51) Int. Cl.
*A47L 7/00* (2006.01)

(52) U.S. Cl. ..... 15/320; 15/321; 15/319

(58) Field of Classification Search ..... 15/302, 15/319, 320, 321; 134/166 R, 166 C, 169 R, 134/115 R, 104.1; 122/4 B; 34/90
See application file for complete search history.

(56) References Cited

U.S. PATENT DOCUMENTS 3,908,602 A * 9/1975 Brulfert et al. ..... 122/4 D
3,911,896 A * 10/1975 Charboneau et al. ..... 122/21
4,803,466 A 2/1989 Gurstein et al. ..... 15/319
4,940,082 A * 7/1990 Roden ..... 15/321
5,371,918 A * 12/1994 Shero ..... 15/321
5,469,598 A * 11/1995 Sales ..... 15/321
5,606,768 A * 3/1997 Sundberg ..... 15/321
5,907,879 A 6/1999 Downey ..... 15/320
6,032,616 A * 3/2000 Jones ..... 15/321
2003/0031971 A1* 2/2003 Sugimoto et al. ..... 431/268

* cited by examiner

*Primary Examiner*—Theresa T. Snider
(74) *Attorney, Agent, or Firm*—Wells St. John P.S.

(57) ABSTRACT

A cleaning apparatus is disclosed and which includes a fluid dispensing tank which dispenses a cleaning fluid; a heat exchanger coupled in downstream fluid flowing relation relative to the fluid dispensing tank; a source of a combustible fluid fuel; a source of air; and a catalytic heater positioned in heat transferring relation relative to the heat exchanger, and which further is coupled in fluid flowing relation relative to the combustible fluid fuel, and wherein the catalytic heater catalytically combusts a substantially nonflammable mixture of the combustible fluid fuel and air to produce heat energy which heats the fluid dispensed from the fluid dispensing tank.

26 Claims, 3 Drawing Sheets

FIG 2+
PRIOR ART

70
71
72
73
FLUID DISPENSING TANK
74
80
FILTER
85
PUMP
90
95
180
181
161
170
FUEL SOURCE
160
162
171
172
161
163
191
CATALYTIC HEATER
190
100
200
CONTROLLER
201
201
111
192
193
150
OPTIONAL CHEMICAL TANK
151
152
105
105
112
120
110
CLEANING FLUID DISPENSER
CLEANING FLUID EXTRACTOR
125
130
VACCUM MOTOR
135
FLUID RECOVERY TANK
140

CLEANING APPARATUS FOR DISPENSING A HEATED CLEANING FLUID

TECHNICAL FIELD

The present invention relates to an apparatus for cleaning carpet, upholstery, draperies, and the like, and more specifically to a cleaning apparatus which employs a catalytic heater for heating a fluid which is sprayed onto the surface of carpet, hard floor, upholstery, or draperies and then subsequently removed by suction.

BACKGROUND OF THE INVENTION

The prior art includes various types of cleaning devices and other machines which have various types of liquid heating assemblies for heating a cleaning fluid and which is subsequently sprayed onto an object to be cleaned and then suctioned back into a recovery tank. An example of such a prior art device is found in U.S. Pat. No. 4,803,466, the teachings of which are incorporated by reference herein. The device exemplified by the aforementioned patent utilizes an electrical heater which has a corresponding heat exchanger. This assembly heats the fluid to be applied to a given temperature before it is applied to the surface which is to be cleaned.

While devices as exemplified in U.S. Pat. No. 4,803,466 have operated with a great deal of success, there are various shortcomings attendant with these prior art assemblies which have detracted from their usefulness. More specifically, such devices as exemplified by this, and other U.S. patents, as a general matter, require a large amount of electrical power in order to sufficiently heat the fluids which are to be applied. Because electrical outlets capable of delivering more than 1800 watts are relatively uncommon in residential and commercial buildings in North America, compromises in temperature rise and/or fluid flow rate must necessarily be made. Consequently, such devices cannot clean carpets as quickly as could devices that had greater power. Furthermore, dependence upon electrical cords for power requires an operator of such prior art devices to start and stop these prior art machines several times when the operator is cleaning a given area, such as a floor, in order to move his power cable to the power outlet most near the area where the cleaning machine is operating. This activity, of course, further slows the progress of cleaning, and also presents inconveniences inasmuch as power cables of the type described often present safety concerns in the form of a tripping hazard for people traveling in the near vicinity of these cleaning machines as they are operating.

In addition to the foregoing, and in some environments, the power cables of such machines may not have a length which will permit such cleaning devices to reach some remote areas. This is often the case in large department stores, and the like, where fixtures such as shelves, displays and counters would inhibit the direct routing of the power cable servicing the cleaning machine which is operating in the area which is being cleaned.

To address this perceived shortcoming, various cleaning devices and machines have been introduced and which include self contained power supplies. These devices typically consist of multiple lead-acid batteries which are utilized to supply power to the cleaning device so it may operate remotely relative to an AC power source.

While cleaning devices having self contained power sources have operated with some degree of success, the useful operational time of such devices is quite limited.

Consequently, an operator must periodically stop these prior art machines either to recharge the batteries utilized with same; or in the alternative, remove the discharged batteries, and replace them with a fully charged set of batteries, so that the machine can continue in operation. This activity of either on the one hand, recharging the batteries, or replacing the discharged batteries with charged batteries further increases the cost and amount of time necessary to clean a given article or area. Those skilled in the art will readily recognize that the continuous and repeated deep discharging of rechargeable batteries will typically shorten the life expectancy of such batteries such that they may need to be replaced on a fairly regular timetable. Still further, machines of this type which have rechargeable batteries which power same are also relatively speaking, large, quite heavy, and difficult to maneuver in small spaces. Still further, the devices are often difficult to maintain.

Therefore, a cleaning machine which overcomes many of the perceived shortcomings of the prior art devices and practices is the subject matter of the present application.

SUMMARY OF THE INVENTION

A first aspect of the present invention relates to a cleaning apparatus which includes a fluid dispensing tank which dispenses a cleaning fluid; a heat exchanger coupled in downstream fluid flowing relation relative to the fluid dispensing tank; a source of a combustible fluid fuel; a source of air; and a catalytic heater positioned in heat transferring relation relative to the heat exchanger, and which further is coupled in fluid flowing relation relative to the combustible fluid fuel, and wherein the catalytic heater catalytically combusts a substantially nonflammable mixture of the combustible fluid fuel and air to produce heat energy which heats the fluid dispensed from the fluid dispensing tank.

Another aspect of the present invention relates to a cleaning apparatus which includes a fluid dispensing tank which dispenses a cleaning fluid which is to be applied to an object of interest; a fluid dispenser coupled in fluid receiving relation relative to the fluid dispensing tank; a heat exchanger disposed downstream of the fluid dispensing tank and upstream of the fluid dispenser, and which is operable to impart heat energy to the fluid moving from the fluid dispensing tank to the fluid dispenser; a catalytic heater disposed in heat transferring relation relative to the heat exchanger; and a fuel supply coupled in fluid flowing relation relative to the catalytic heater, and wherein the combustion of the fuel supply with a source of air by the catalytic heater produces substantially no toxic emissions, and generates heat energy which heats the cleaning fluid dispensed by the fluid dispensing tank.

Yet another aspect of the present invention relates to a cleaning apparatus which includes a housing defining an internal cavity; a fluid dispensing tank borne by the housing and which receives a source of fluid to be dispensed to an object of interest; a pump enclosed within the housing and which is coupled in fluid removing relation relative to the fluid dispensing tank; a heat exchanger coupled in fluid receiving relation relative to the pump; a fluid dispenser coupled in fluid flowing relation relative to the heat exchanger and which dispenses the fluid from the fluid dispensing tank to an object of interest, and which is further coupled in selective fluid flowing relation relative to the fluid dispensing tank; a source of a fuel borne by the housing; and a catalytic heater assembly coupled in fluid flowing relation relative to the source of fuel and which further is disposed in heat transmitting relation relative to the heat exchanger, and wherein the catalytic heater assembly, when supplied with the source of fuel, heats the fluid dispensed by fluid dispensing tank so that the heated fluid may be delivered to the object of interest.

Another aspect of the present invention relates to a cleaning apparatus which includes a wheeled chassis which is operable to be moved across a supporting surface; a fluid dispensing tank borne by the chassis and which dispenses a cleaning fluid which is to be applied to an object of interest; a fluid recovery tank borne by the chassis and which receives cleaning fluid which is removed from the object of interest; a fluid dispenser coupled in selective fluid flowing relation relative to the fluid dispensing tank and which dispenses the cleaning fluid onto the object of interest; a fluid extractor coupled in fluid flowing relation relative to the fluid recovery tank and which removes the fluid dispensed by the fluid dispenser onto the object of interest; a heat exchanger disposed downstream of the of the fluid dispensing tank, and upstream of the fluid dispenser, and which is operable to transmit heat energy to the cleaning fluid which travels from the fluid dispensing tank to the fluid dispenser; a source of a fuel borne by the wheeled chassis and which provides a fuel stream; an air stream mixed with the fuel stream provided by the source of fuel to produce a substantially nonflammable mixture of the fuel and air; a catalytic heater borne by the chassis and disposed in fluid receiving relation relative to the substantially nonflammable mixture of the fuel and air, and wherein the catalytic heater, when supplied with the substantially nonflammable mixture of the fuel and air produces heat energy which is supplied to the heat exchanger for heating the cleaning fluid, and wherein the combustion produces substantially no toxic emissions; a temperature sensor disposed downstream of the heat exchanger for detecting the temperature of the cleaning fluid which has been heated by the heat exchanger; a first remotely controllable fluid flow control device for selectively metering the fuel stream which is combined with the air stream to produce the substantially nonflammable mixture of the fuel and air, and which is catalytically combusted by the catalytic heater; a second remotely controllable fluid flow control device for directing the heated cleaning fluid to the fluid dispenser, and/or the fluid dispensing tank; a fuel sensor disposed downstream of the catalytic heater, and which is operable to detect any uncombusted fuel which passes through the catalytic heater; and a controller borne by the chassis and which is electrically coupled in sensing relation relative to the temperature sensor, and the fuel sensor, and which further is disposed in controlling relation relative to the remotely controllable fluid flow control device.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
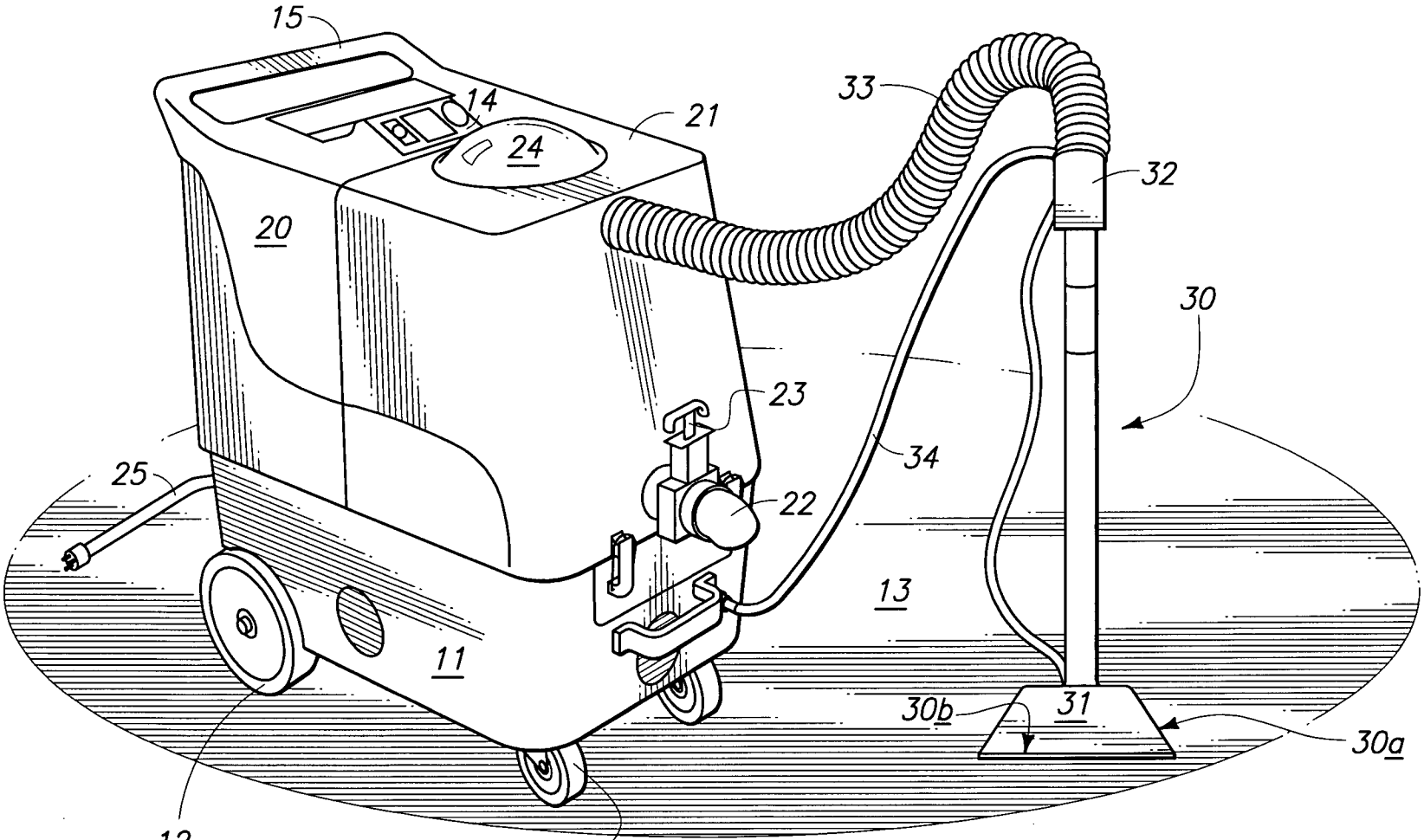
FIG 1 PRIOR ART
FIG. 1 is a perspective side elevation view of one form of a prior art cleaning device which is employed to clean carpeting.
Figure 2:
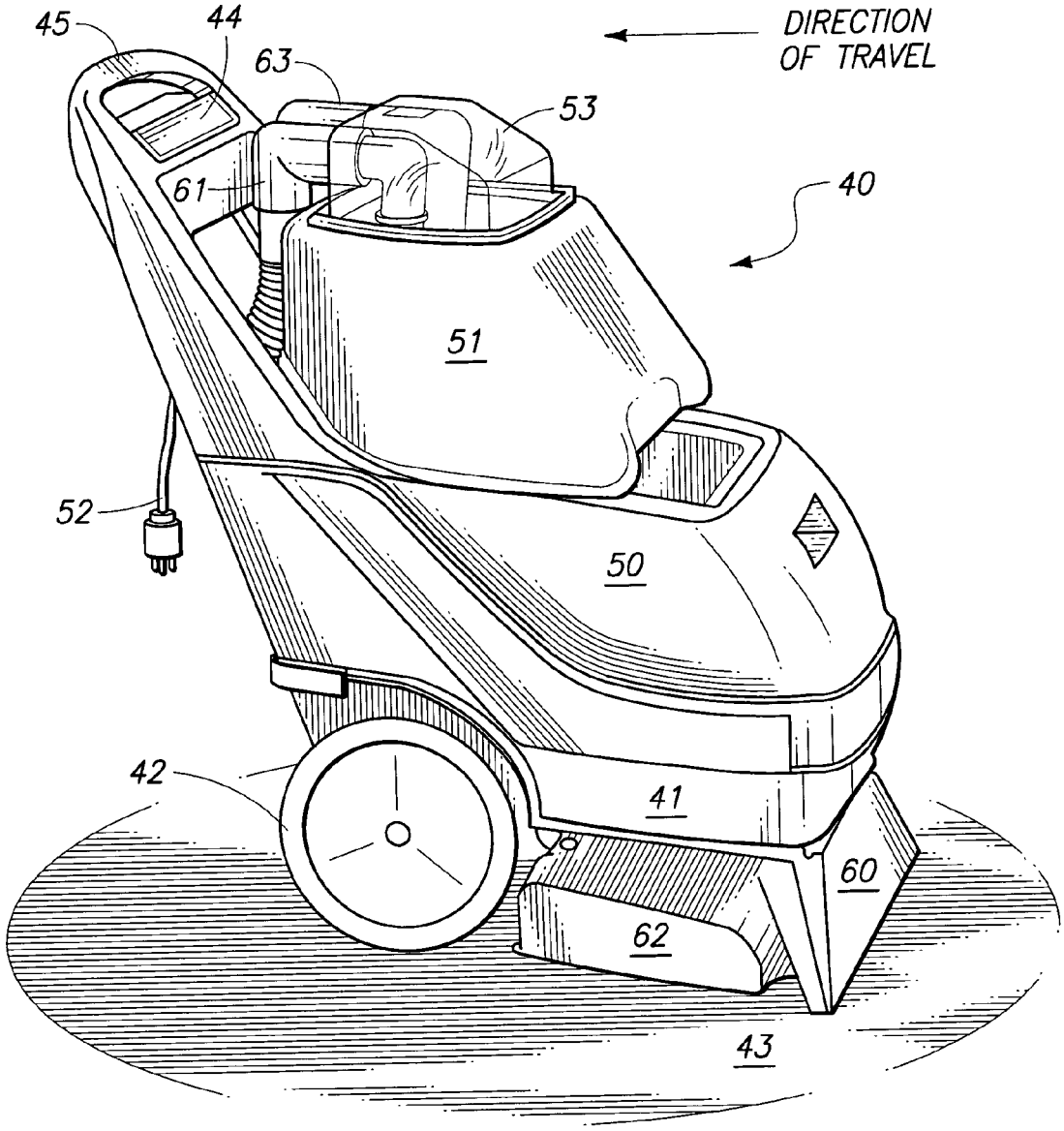
FIG. 2 is a perspective side elevation view of a second prior art cleaning device which is employed to clean carpeting or hard flooring using a different recovery system.
Figure 3:
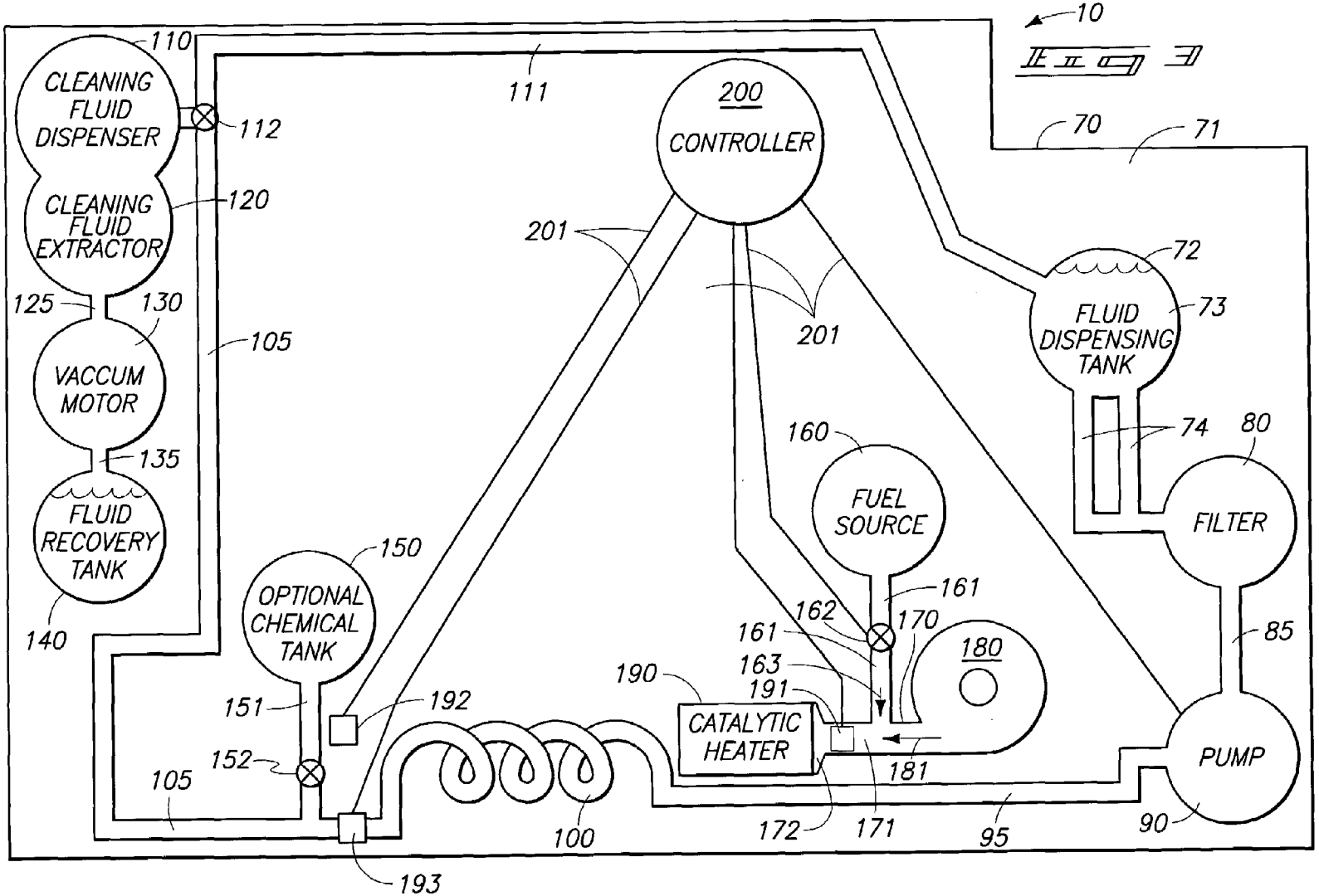
FIG. 3 is a simplified schematic drawing showing the features of the present invention.

The cleaning apparatus of the present invention is generally indicated by the numeral 10 in FIG. 3. The features of the invention 10 may be incorporated into various prior art devices such as shown in FIG. 1 and FIG. 2. As should be understood, these cleaning devices may be powered, at least in part, by an AC power source. The teachings of the present invention can also be utilized on prior art devices that have self-contained rechargeable power supplies such as lead-acid batteries. In this regard, it should be understood that utilization of the present invention on a device such as one that has self-contained rechargeable batteries will greatly extend the useful operational time of such assemblies inasmuch as the present invention eliminates a significant amount of the power drawn from such batteries thereby extending the useful operational time of same.

Referring now to FIG. 1, a prior art carpet cleaning device identified as the HHP-150 and which is manufactured and sold by U.S. Products of Hayden, Id. is illustrated. It will be seen that this prior art carpet cleaning device or extractor has a chassis 11 which mounts several wheels 12 which support the chassis for rolling engagement across a supporting surface 13. The prior art device shown in FIG. 1 includes a control panel 14 which permits an operator (not shown) to control various aspects of the operation of the prior art device shown in FIG. 1. Still further, the prior art device includes a handle 15, which is coupled to the chassis 11, and which permits an operator to roll the chassis 11 to various locations where cleaning operations are being conducted. The prior art device shown in FIG. 1 also includes a fluid holding tank 20 and which is filled with hot water from a local source. Therefore, the temperature of the cleaning fluid in the holding tank is limited to the temperature of the water delivered to the tank by the local source.

The prior art device as shown in FIG. 1 further includes a fluid recovery tank which is generally indicated by the numeral 21, and which is borne by the chassis 11. The fluid recovery tank is positioned adjacent to the fluid holding tank 20. The fluid recovery tank 21 includes a drain fixture 22 which permits the fluid recovery tank 21 to be emptied once cleaning operations have been completed. A valve 23 is borne by the drain fixture 22 and permits the drain to be selectively opened to drain the fluid recovery tank. The fluid recovery tank includes a transparent dome 24 which permits an operator to view into the fluid recovery tank to determine the nature of the cleaning fluid being returned to the fluid recovery tank. The prior art device shown in FIG. 1 is electrically coupled to an exterior AC power source by means of a power cord 25.

The prior art apparatus shown in FIG. 1 includes a fluid applicator/recovery tool which is generally indicated by the numeral 30, and which is removably coupled to the moveable chassis 11. The fluid applicator/recovery tool 30 includes a first end 31 which is moved by hand, in a given pattern across the supporting surface 13. Still further, the fluid applicator/recovery tool 30 has an opposite second end 32, which is grasped by the operator (not shown). A vacuum hose 33 couples the second end 32 of the fluid applicator/recovery tool to the fluid recovery tank 21. Yet further, a cleaning fluid delivery conduit 34 is coupled in fluid flowing relation to the fluid holding tank 20, and is operable to deliver the cleaning fluid contained therein to the fluid applicator/recovery tool 30. Those skilled in the art will recognize that the prior art device delivers the cleaning fluid from the fluid holding tank 20 to the fluid applicator portion 30*a* of the fluid applicator/recovery tool 30, and thereafter the recovery tool portion of same 30*b* is drawn across the area of the supporting surface 13 where the cleaning fluid has been applied. This cleaning fluid is suctioned, along with any dissolved dirt or other debris found on the supporting surface 13 into the recovery tool portion 30B and is delivered to the fluid recovery tank 21.

Referring now to FIG. 2, a second prior art device 40 is shown and which can also be utilized to clean carpets and the like. The second prior art device 40 has a chassis 41 which is mounted on a pair of wheels 42 and which moveably engage a supporting surface 43 to be cleaned. The prior art device 40 has a control panel 44 which is closely adjacent to a handle 45. The handle 45 is utilized by an operator, not shown, and which permits the operator to maneuver the prior art device 40 during operation. The device 40 is typically drawn backwards, or in the direction of the arrow as shown in FIG. 2 while the device is operation. The prior art device 40 includes a fluid holding tank 50 which receives heated water, and other detergents which are to be applied to the supporting surface 43. Still further, the chassis 41 supports a fluid recovery tank 51 which receives debris and dirt vacuumed from the supporting surface 43, as well as cleaning liquid which has been applied, and then recovered from the supporting surface 43. The fluid recovery tank 51, once filled to capacity, is drained into an appropriate drain. Thereafter, the fluid holding tank 50 is refilled with heated water and other detergent for purposes of continuing the cleaning operation. The device 40, as seen in FIG. 2 includes a power cable 52 which provides AC power to operate same. Still further, a transparent dome 53 covers the fluid recovery tank 51, and allows the operator to view the contents of the tank. Similar to the device shown in FIG. 1, this second prior art device 40 includes a fluid applicator/beater-bar tool 62 which incorporates one or more spray nozzles that are operable to deliver the cleaning fluid and detergent contained within the fluid holding tank 50 to the supporting surface 43. The applicator/beater-bar tool 62 also incorporates a beater-bar (not shown) that is operable to work the cleaning fluid into the fibers of the supporting surface 43. Thereafter, the vacuum shoe 60 vacuums this same liquid back up along with any debris and dirt that is dissolved or suspended within this cleaning fluid and delivers it to the fluid recovery tank 51 by way of a first vacuum hose 61. Still further, the second prior art device 40 includes a second hose 63 which is operable to couple the vacuum pump in fluid flowing relation, (not shown), to the fluid recovery tank 51.

As with the first prior art device shown in FIG. 1, this second prior art device includes no means by which fluid delivered to the fluid holding tank can be heated to a given temperature. Therefore, the temperature of any cleaning fluid such as water delivered to a supporting surface 43 is totally dependent upon the temperature of the water that is delivered to the holding tank and as might be available at the location where cleaning operations are being conducted.

Referring now to FIG. 3, the present invention 10 is illustrated schematically. It should be appreciated that the present invention may be incorporated into the prior art devices shown in FIGS. 1 and 2. The invention 10 includes a housing which is generally indicated by the numeral 70. The housing would be mounted in a fashion upon wheels (not shown) for travel across a supporting surface. The housing 70 has an internal cavity 71 which encloses a fluid dispensing tank which is generally indicated by the numeral 72. The fluid dispensing tank 72 would be accessible from a location outside of the housing 70 so that a cleaning fluid such as water, or water and a mixture of detergents of various types may be placed in same. As illustrated in FIG. 3, a pair of fluid conduits 74 form a fluid loop which permits the fluid 73 to be circulated by means of a pump (not shown) when the apparatus 10 is not in operation.

As seen in FIG. 3, a filter assembly which is generally indicated by the numeral 80 is coupled in fluid flowing relation relative to the pair of fluid conduits 74, and is operable to remove particulate or other sedimentary materials which is delivered from the fluid dispensing tank 72. The filter assembly 80 is coupled in fluid flowing relation relative to a fluid conduit 85. This same fluid conduit 85 is coupled in downstream fluid flowing relation relative to a pump which is generally indicated by the numeral 90. The pump is of conventional design and may be energized by means of a remote AC power source, or further may be energized by means of a rechargeable DC power source such as a plurality of lead-acid batteries which are moveably borne by the housing of the cleaning apparatus 10. The pump 90 is coupled by way of a fluid conduit 95 to a heat exchanger which is generally indicated by the numeral 100. The heat exchanger 100 is then coupled to a fluid conduit 105. The fluid conduit 105 is coupled in fluid flowing relation relative to a cleaning fluid dispenser which is generally indicated by the numeral 110.

As seen in FIG. 3, the invention includes a fluid conduit 111 which couples the cleaning fluid dispenser 110 in selective fluid flowing relation relative to the fluid dispensing tank 72. As seen in FIG. 3, a remotely controllable fluid flow control device 112 is provided, and which is operable to direct the heated cleaning fluid 73 to the cleaning fluid dispenser 110 and/or fluid dispensing tank 72 under certain operational conditions which will be discussed in greater detail hereinafter. The cleaning fluid dispenser may be made integral with a fluid extractor or recovery tool which is generally indicated by the numeral 120. In some forms of the invention, these two assemblies may be separate and distinct. The fluid dispenser 110, and fluid extractor 120 may also be of a similar construction to that discussed earlier with respect to the prior art devices shown in FIGS. 1 and 2. The cleaning fluid extractor 120 is coupled in fluid flowing relation relative to a vacuum motor 130 which is borne by the housing 70. The vacuum motor 130 is operable to remove cleaning fluid which has been dispensed by the fluid dispenser 110 onto an object of interest such as carpeting. The suction provided by the vacuum motor 130 recovers the cleaning fluid from the object of interest and delivers same into a fluid recovery tank which is generally indicated by the numeral 140. Referring still to FIG. 3 it will be seen that the housing 70 may further include an optional chemical tank 150 within which detergents of various types can be placed so that they may be added to the cleaning fluid (typically water) which is dispensed from the fluid dispensing tank 72. The optional chemical tank 150 is coupled by way of a fluid conduit 151 to the fluid conduit 105. A valve 152 is provided and which may meter the contents of the optional chemical tank to the fluid conduit 105.

As best seen by reference to FIG. 3, a fuel source 160 is provided, and which is borne by the housing 70 and which provides a source of fuel which may be rendered combustible and utilized by a catalytic heater which will be discussed in further detail hereinafter. The fuel source may comprise bottled hydrogen, methanol, or any other fuel which may be mixed with a source of air, such as ambient air, in order to provide a combustible mixture. The fuel source 160 is coupled in fluid flowing relation relative to a fuel conduit 161. Mounted along the fuel conduit is a remotely controllable fluid flow control device 162 which when rendered operational, produces a fuel stream generally indicated by the numeral 163. The fuel stream is coupled by way of the fuel conduit 161 to a heating enclosure which is generally indicated by the numeral 170. The heating enclosure defines a passageway 171. Moreover, the heating enclosure may further include a mixing plenum or portion 172 which substantially mixes the air stream 181 with the fuel stream 163 which is supplied to the passageway 171. A blower assembly 180 is mounted on the heating enclosure 170, and is operable, when energized, to produce an air stream 181 either from a separate source of air, or from the surrounding ambient air, and which is delivered to the heating enclosure. As illustrated, the source of combustible fuel 160 is mixed with the air stream 181 and which is produced by the blower assembly 180 in predetermined amounts. This mixture of combustible fluid fuel and air has a stoichiometry which is defined, in part, by a lower explosive limit. In the arrangement as shown, the mixture of fuel stream 163 provided by the fuel source 160, and the air stream 181 provided by the blower 180 comprises a nonflammable mixture which has a stoichiometry of less than about one-half (½) of the lower explosive limit during normal operation of the cleaning apparatus 10. In one form of the invention, the fuel source 160 comprises hydrogen. If this fuel is used, it has been found convenient to employ a mixture of hydrogen and air which contains less than about 2% by volume during normal operation.

Mounted on the heating enclosure 170, and coupled in fluid flowing relation relative to the passageway 171 is a catalytic heater 190. The catalytic heater may comprise a substantially monolithic catalyst block, or any other design which, when supplied with the non-explosive mixture of air and fuel provides a sufficient amount of heat to heat the cleaning fluid moving through the heat exchanger 100. Still further, and as seen in FIG. 3, it will be noted that an air stream or air flow sensor 191 is mounted in sensing relation relative to the passageway 171. This sensor 191 is operable to detect the volume of the air stream 181 which is mixed with the combustible fluid fuel 160. The sensor 191 produces an electrical signal representative of this air volume. Still further, it will be seen from FIG. 3 that a fuel sensor 192 is provided in downstream sensing relation relative to the heat exchanger 100. The fuel sensor 192 is operable to detect any fuel 160 which passes through the catalytic heater 190. Still further, a temperature sensor which is generally indicated by the numeral 193 is disposed in downstream sensing relation relative to the heat exchanger 100 and is operable to detect the temperature of the cleaning fluid which has been heated by the heat exchanger 100.

As seen in FIG. 3, a controller 200 is provided and which is coupled by way of electrical pathways 201 with the pump 90; the remotely controllable fluid flow control devices 112 and 162; the air flow sensor 191; the fuel sensor 192; and the temperature sensor 193. The controller 200 is operable to coordinate the operation of these various devices so that the catalytic heater 190 produces heat in an amount which reliably heats the cleaning fluid provided by the pump 90 to the heat exchanger 100 such that the temperature of the cleaning fluid exiting the heat exchanger 100 as sensed by the temperature sensor 193 may be delivered at an appropriate temperature to the cleaning fluid dispenser 110. The current arrangement as seen in FIG. 3 permits the controller 200 to cause the remotely controllable fluid flow control device 112 to direct the heated cleaning fluid 73 to the cleaning fluid dispenser 110 and/or the fluid dispensing tank 72. When cleaning fluid 73 is delivered back to the fluid dispensing tank 72, the temperature of the cleaning fluid 73 correspondingly increases. As the temperature increases, the controller is operable to decrease the amount of heat energy delivered by the catalytic heater 190 to the heat exchanger 100. This facilitates the conservation of fuel provided by the fuel source 160.

OPERATION

The operation of the described embodiment of the present invention 10 is believed to be readily apparent and is briefly summarized at this point. The invention 10 is best seen in FIG. 3 and may be made integral or is incorporated within prior art devices such as shown in FIGS. 1 and 2. The present invention 10 includes the fluid dispensing tank 72 which is operable to dispense a cleaning fluid 73. The heat exchanger 100 is coupled in downstream fluid flowing relation relative to the fluid dispensing tank 72. The source of a combustible fluid fuel 160, and the source of air, such as ambient air are provided. The catalytic heater 190 is positioned in heat transferring relation relative to the heat exchanger 100, and which further is coupled in fluid flowing relation relative to the combustible fluid fuel 160. The catalytic heater 190 catalytically combusts a substantially nonflammable mixture of the combustible fluid fuel 160 with air (typically ambient air) to produce heat energy which heats the fluid dispensed from the fluid dispensing tank 72. More specifically, and as earlier discussed the pump 90 is coupled in fluid flowing relation relative to the fluid dispensing tank 72 and is operable to remove the cleaning fluid 73 and supply it to the heat exchanger 100. The filter assembly 80 is provided and which is operable for removing particulate matter from the cleansing fluid 73. The filter assembly 80 is disposed in downstream fluid flowing relation relative to the fluid dispensing tank, and in upstream fluid flowing relation relative to the pump. As seen in FIG. 3, the first remotely controllable fluid flow control device 162 is provided, and which is operable to meter the source of combustible fluid fuel 160. Still further, the second remotely controllable fluid flow control device 112 is provided and which directs the heated cleaning fluid 73 to the cleaning fluid dispenser 110 and/or the fluid dispensing tank 72. The controller 200 is also provided, and coupled in controlling relation relative to the first and second remotely controllable fluid flow control devices 162 and 112, respectively. The controller, by means of the fluid flow control device 162 causes the selective delivery of the combustible fluid fuel 160 to the catalytic heater 190. As earlier discussed, the blower assembly 180, when energized by the controller 200, supplies the air stream 181 which is mixed with the stream of combustible fluid fuel 163 supplied by the source of combustible fluid fuel source 160. As earlier noted, the fluid dispenser 110 is coupled in downstream fluid receiving relation relative to the heat exchanger 100 and is operable to dispense the heated cleaning fluid 73 on an object of interest such as carpeting and the like.

Therefore the cleaning apparatus 10 of the present invention includes a wheeled chassis such as what is shown with the prior art devices at 11 and 41. The fluid dispensing tank 72 is borne by the chassis of this type, and dispenses the cleaning fluid 73 which is to be applied to an object of interest such as the supporting surface 13 which may have carpet or other flooring surfaces positioned thereon. The fluid recovery tank 140 is provided, and is borne by the chassis, and which receives cleaning fluid which is removed from the object of interest such as the supporting surface. The fluid dispenser 110 is coupled in fluid flowing relation relative to the fluid dispensing tank 72 and dispenses the heated cleaning fluid 73 on the object of interest. The fluid extractor 120 is coupled in fluid flowing relation relative to the fluid recovery tank 140, and removes the fluid dispensed by the fluid dispenser 110 onto the object of interest. The heat exchanger 100 is disposed downstream of the fluid dispensing tank 72, and upstream of the fluid dispenser 110. The heat exchanger is operable to transmit heat energy to the cleaning fluid which travels from the fluid dispensing tank 72 to the fluid dispenser 100. The source of a fuel 160 is borne by the wheeled chassis. Still further, and as seen in FIG. 3, the air stream 181 is provided by means of a blower 180 or the like and is mixed with the source of fuel 160 to produce a substantially nonflammable mixture of the fuel and air. The catalytic heater 190 is borne by the chassis, and disposed in fluid receiving relation relative to the substantially nonflammable mixture of the fuel and air. The catalytic heater 190, when supplied with the substantially nonflammable mixture of the fuel and air produces heat energy which is supplied to the heat exchanger for heating the cleaning fluid 73. The combustion of this substantially nonflammable mixture produces substantially no toxic emissions. As earlier discussed the temperature sensor 193 is disposed downstream of the heat exchanger 100 and is operable to detect the temperature of the cleaning fluid 73 which has been heated by the heat exchanger 100. The remotely controllable fluid flow control device 162 is provided and which selectively meters the source of fuel 160 to produce the fuel stream 163 which is combined with the air stream 191 to produce the substantially nonflammable mixture of the fuel and air. The fuel sensor 192 is provided, and which is disposed downstream of the catalytic heater 100 and which is operable to detect any uncombusted fuel 160 which passes through the catalytic heater 190. The controller is borne by the chassis, and which is electrically coupled in sensing relation relative to the temperature sensor 193, and the fuel sensor 192, and which further is disposed in controlling relation relative to the remotely controllable fluid flow control device 162.

Therefore it will be seen that the cleaning apparatus 10 of the present invention, is best seen in FIG. 3, provides a convenient means by which many of the perceived shortcomings of the prior art devices as earlier discussed are easily overcome and further provides a cleaning apparatus which is operable to reliably deliver heated cleaning fluid to an object to be cleaned in a manner not possible heretofore. The present cleaning apparatus 10 further provides enhanced operational capability for prior art devices such as illustrated in FIGS. 1 and 2 and may be further incorporated into same.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A cleaning apparatus for dispensing a heated cleaning fluid comprising:

a fluid dispensing tank which dispenses a cleaning fluid;

a heat exchanger coupled in downstream fluid flowing relation relative to the fluid dispensing tank;

a source of a combustible fluid fuel;

a source of air;

a catalytic heater positioned in heat transferring relation relative to the heat exchanger, and which further is coupled in fluid flowing relation relative to the source of combustible fluid fuel, and wherein the catalytic heater catalytically combusts a substantially nonflammable mixture of the source of combustible fluid fuel and air to produce heat energy which heats the cleaning fluid dispensed from the fluid dispensing tank, and wherein the mixture of the source of combustible fluid fuel and air has a stoichiometry which is defined, in part, by a lower explosive limit, and wherein the nonflammable mixture of the combustible fluid fuel and air has a stoichiometry of less than about one-half of the lower explosive limit during normal operation; and a fluid dispenser coupled in downstream fluid flowing relation relative to the fluid dispensing tank, and which is operable to dispense the heated cleaning fluid on an object of interest.

2. The cleaning apparatus as claimed in claim 1, and further comprising:

a pump coupled in fluid flowing relation relative to the fluid dispensing tank and which is operable to remove the cleaning fluid and supply it to the heat exchanger; and a filter for removing particulate matter from the cleaning fluid and which is disposed in downstream fluid flowing relation relative to the fluid dispensing tank, and in upstream fluid flowing relation relative to the pump.

3. The cleaning apparatus as claimed in claim 1, and further comprising:

a remotely controllable fluid flow control device disposed in selective fluid metering relation relative to the source of combustible fluid fuel; and a controller controllably coupled with the remotely controllable fluid flow control device and which causes the selective delivery of the combustible fluid fuel to the catalytic heater.

4. The cleaning apparatus as claimed in claim 1, and further comprising:

a blower assembly, which when energized, supplies the source of air which is mixed with a stream of combustible fluid fuel supplied by the source of combustible fluid fuel;

an air flow sensor positioned in a location to detect the rate of air flow supplied by the blower assembly and which produces a signal representative of the rate of air flow;

a remotely controllable fluid flow control device disposed in selective fluid metering relation relative to the source of the combustible fluid fuel; and a controller electrically coupled with the air flow sensor and which detects the air stream which is produced by the blower and which is mixed with the source of combustible fluid fuel, and which further regulates the remotely controllable fluid flow control device to insure that the mixture of air and the combustible fluid fuel is substantially nonflammable during normal operation.

5. The cleaning apparatus as claimed in claim 1, and further comprising:

a heating enclosure which defines a passageway;

a blower assembly mounted on the heating enclosure, and which, when energized, produces an air stream from the source of air, and which is delivered to the heating enclosure, and wherein the source of the combustible fluid fuel is delivered to the passageway of the heating enclosure and mixed with the air stream;

an air stream sensor mounted in sensing relation relative to the passageway of the heating enclosure and which is operable to detect the volume of the air stream which is mixed with the combustible fluid fuel and which produces a signal representative of the air volume; and a controller electrically coupled with the air stream sensor and which is further disposed in controlling relation relative to the source of the combustible fluid fuel to controllably deliver the source of the combustible fluid fuel to the passageway, and wherein the catalytic heater is mounted on the heating enclosure.

6. The cleaning apparatus as claimed in claim 1, and further comprising:

a temperature sensor located in a position to detect the temperature of the heated cleaning fluid which is leaving the heat exchanger;

a fuel sensor positioned adjacent to the catalytic heater, and which is operable to detect any noncombusted fuel which passes through the catalytic heater; and a controller coupled in sensing relation relative to both the temperature, and fuel sensors.

7. The cleaning apparatus as claimed in claim 1, and:

wherein the fluid dispenser is coupled in downstream fluid flowing relation relative to the heat exchanger, and wherein the cleaning apparatus further comprises:

a conduit coupling the fluid dispenser with the fluid dispensing tank; and a valve for selectively diverting the heated cleaning fluid to the fluid dispensing tank, or the fluid dispenser.

8. The cleaning apparatus as claimed in claim 7, and further comprising:

a moveable carriage, and wherein the fluid dispensing tank, heat exchanger, source of combustible fluid fuel, and the catalytic heater are mounted on the moveable carriage, and wherein the fluid dispenser is borne by the moveable carriage.

9. The cleaning apparatus as claimed in claim 7, and further comprising:

a moveable carriage, and wherein the fluid dispensing tank, heat exchanger, source of combustible fluid fuel, and catalytic heater are mounted on the moveable carriage, and wherein the fluid dispenser is coupled to the carriage by a fluid conduit.

10. The cleaning apparatus as claimed in claim 1, and further comprising:

a fluid recovery tank which is operable to receive the cleaning fluid once it has been previously dispensed by the cleaning apparatus.

11. A cleaning apparatus for dispensing a heated cleaning fluid, comprising:

a fluid dispensing tank which dispenses a cleaning fluid which is to be applied to an object of interest;

a fluid dispenser coupled in fluid receiving relation relative to the fluid dispensing tank and which dispenses the cleaning fluid on the object of interest;

a heat exchanger disposed downstream of the fluid dispensing tank and upstream of the fluid dispenser, and which is operable to impart heat energy to the cleaning fluid moving from the fluid dispensing tank to the fluid dispenser;

a catalytic heater disposed in heat transferring relation relative to the heat exchanger;

a fuel supply coupled in fluid flowing relation relative to the catalytic heater, and wherein the combustion of the fuel supply with a source of air by the catalytic heater produces substantially no toxic emissions, and generates heat energy which heats the cleaning fluid dispensed by the fluid dispensing tank;

a waste cleaning fluid recovery tank; and a waste cleaning fluid recovery tool which is coupled in fluid flowing relation relative to the waste cleaning fluid recovery tank, and wherein the fluid dispenser is mounted near the waste cleaning fluid recovery tool.

12. The cleaning apparatus as claimed in claim 11, and further comprising:

a blower assembly, which when energized, produces an air stream which is supplied to and mixed with a fuel stream supplied from the fuel supply to provide a nonflammable mixture of the fuel and air to the catalytic heater.

13. The cleaning apparatus as claimed in claim 12, and wherein the fuel supply is hydrogen and wherein the nonflammable mixture of hydrogen and air contains less than about 2% hydrogen by volume during normal operation.

14. The cleaning apparatus as claimed in claim 11, and further comprising:

a heating enclosure which defines a passageway;

a blower assembly mounted adjacent to the enclosure and which, when energized, produces an air stream which is directed along the passageway, and wherein the catalytic heater is positioned in fluid flowing relation relative to the heating enclosure;

an air flow sensor positioned in the passageway and which is operable to detect the volume of the air stream;

a remotely controllable fluid flow control device which is disposed in selective fluid metering relation relative to the fuel supply, and wherein the remotely controllable fluid flow control device selectively delivers a fuel stream from the supply of fuel to the passageway, and wherein the remotely controllable fluid flow control device further delivers the fuel stream in an amount which when mixed with the air stream results in a substantially nonflammable mixture; and a controller coupled in controlling relation relative to the remotely controllable fluid flow control device, and the blower assembly, and which further is disposed in sensing relation relative to the air flow sensor, the controller causing the delivery of the fuel stream following the creation and detection of the air stream so as to create the substantially nonflammable mixture which is delivered to the catalytic heater for combustion.

15. The cleaning apparatus as claimed in claim 14, and wherein the catalytic heater comprises a substantially monolithic catalyst block.

16. The cleaning apparatus as claimed in claim 15, and wherein the heating enclosure further defines a mixing plenum which substantially mixes the air stream with the fuel stream supplied to the passageway.

17. A cleaning apparatus for dispensing a heated cleaning fluid, comprising:

a housing defining an internal cavity;

a fluid dispensing tank borne by the housing and which receives a source of a cleaning fluid to be dispensed to an object of interest;

a pump enclosed within the housing and which is coupled in fluid removing relation relative to the fluid dispensing tank;

a heat exchanger coupled in fluid receiving relation relative to the pump;

a fluid dispenser coupled in fluid flowing relation relative to the heat exchanger and which dispenses the cleaning fluid from the fluid dispensing tank on an object of interest, and which is further coupled in selective fluid flowing relation relative to the fluid dispensing tank;

a source of a fuel borne by the housing; and a catalytic heater assembly coupled in fluid flowing relation relative to the source of fuel and which further is disposed in heat transmitting relation relative to the heat exchanger, and wherein the catalytic heater assembly, when supplied with the source of fuel, heats the cleaning fluid dispensed by fluid dispensing tank so that the heated cleaning fluid may be delivered to the object of interest.

18. The cleaning apparatus as claimed in claim 17, and further comprising;

a heating enclosure defining a passageway;

a blower assembly located adjacent to the heating enclosure, and which, when energized, produces an air stream, having a volume, and which is delivered to the passageway, and wherein the catalytic heater is mounted on the heating enclosure;

a fuel delivery conduit coupled in fluid flowing relation relative to the source of fuel and with the passageway, the fuel delivery conduit delivering a fuel stream formed from the source of the fuel to the passageway at a location which is downstream of the blower, and upstream of the catalytic heater;

a first remotely controllable fluid flow control device borne by the fuel delivery conduit and which is operable to selectively meter the fuel stream to the passageway; and a second remotely controllable fluid flow control device which directs the heated cleaning fluid to the fluid dispenser and/or the fluid dispensing tank.

19. A The cleaning apparatus as claimed in claim 18, and further comprising:

an air flow sensor positioned in the passageway, and which is operable to detect the volume of the air stream generated by the blower assembly;

a temperature sensor disposed downstream of the heat exchanger, and upstream of the fluid dispenser, and which is operable to detect the temperature of the cleaning fluid as the cleaning fluid departs from the heat exchanger; and a fuel sensor disposed downstream of the catalytic heater and which is operable to detect the presence of fuel which has not been consumed by the catalytic heater.

20. The cleaning apparatus as claimed in claim 19, and further comprising:

a controller operably coupled with the pump, first and second remotely controllable fluid flow control devices; air blower assembly; air flow sensor; temperature sensor and fuel sensor, and wherein the controller causes the air blower to deliver an air stream to the passageway, and the first remotely controllable fluid flow control device to deliver the fuel stream in an amount to the passageway which results in a substantially nonflammable mixture which is delivered to the catalytic heater; and wherein the controller further causes the second remotely controllable fluid flow control device to direct the heated cleaning fluid to either of the fluid dispenser or the fluid dispensing tank.

21. The cleaning apparatus as claimed in claim 20, and wherein the controller does not permit the first remotely controllable fluid flow control device to deliver the fuel stream to the passageway until the controller energizes the air blower assembly and then detects, by way of the air flow sensor, the presence of the air stream in the passageway.

22. The cleaning apparatus as claimed in claim 21, and wherein the controller, upon sensing the presence of fuel at a location downstream of the catalytic heater, is operable to adjust the first remotely controllable valve to reduce the amount of the fuel stream delivered to the passageway.

23. A cleaning apparatus, comprising:

a wheeled chassis which is operable to be moved across a supporting surface;

a fluid dispensing tank borne by the chassis and which dispenses a cleaning fluid which is to be applied to an object of interest;

a fluid recovery tank borne by the chassis and which receives cleaning fluid which is removed from the object of interest;

a fluid dispenser coupled in selective fluid flowing relation relative to the fluid dispensing tank and which dispenses the cleaning fluid onto the object of interest;

a fluid extractor coupled in fluid flowing relation relative to the fluid recovery tank and which removes the fluid dispensed by the fluid dispenser onto the object of interest;

a heat exchanger disposed downstream of the fluid dispensing tank, and upstream of the fluid dispenser, and which is operable to transmit heat energy to the cleaning fluid which travels from the fluid dispensing tank to the fluid dispenser;

a source of a fuel borne by the wheeled chassis and which provides a fuel stream;

an air stream mixed with the fuel stream provided by the source of fuel to produce a substantially nonflammable mixture of the fuel and air;

a catalytic heater borne by the chassis and disposed in fluid receiving relation relative to the substantially nonflammable mixture of the fuel and air, and wherein the catalytic heater, when supplied with the substantially nonflammable mixture of the fuel and air produces heat energy which is supplied to the heat exchanger for heating the cleaning fluid, and wherein the combustion produces substantially no toxic emissions;

a temperature sensor disposed downstream of the heat exchanger for detecting the temperature of the cleaning fluid which has been heated by the heat exchanger;

a first remotely controllable fluid flow control device for selectively metering the fuel stream which is combined with the air stream to produce the substantially nonflammable mixture of the fuel and air, and which is catalytically combusted by the catalytic heater;

a second remotely controllable fluid flow control device for directing the heated cleaning fluid to the fluid dispenser, or the fluid dispensing tank;

a fuel sensor disposed downstream of the catalytic heater, and which is operable to detect any fuel which passes through the catalytic heater; and a controller borne by the chassis and which is electrically coupled in sensing relation relative to the temperature sensor, and the fuel sensor, and which further is disposed in controlling relation relative to the first and second remotely controllable fluid flow control devices.

24. The cleaning apparatus as claimed in claim 23, and wherein the second remotely controllable fluid flow control device is rendered operable by the controller to direct the heated cleaning fluid to the fluid dispensing tank to increase the temperature of the cleaning fluid enclosed within the fluid dispensing tank.

25. The cleaning apparatus as claimed in claim 24, and wherein the second remotely controllable fluid flow control device is rendered operable by the controller to direct a first portion of the heated cleaning fluid to the fluid dispenser, and a second portion of the heated cleaning fluid to the fluid dispensing tank.

26. The cleaning apparatus as claimed in claim 24, and wherein the controller reduces the amount of heat energy produced by the catalytic heater as the temperature of the cleaning fluid increases.

* * * * *